US006129519A

United States Patent [19]

Ogura

[11] Patent Number: 6,129,519

[45] Date of Patent: Oct. 10, 2000

[54] VARIABLE DISPLACEMENT COMPRESSOR IN WHICH A DISPLACEMENT CONTROL IS IMPROVED AT AN INITIAL STAGE OF THE START-UP THEREOF

[75] Inventor: Toshiyuki Ogura, Gunma, Japan

[73] Assignee: Sanden Corporation, Gunma, Japan

[21] Appl. No.: 09/126,321

[22] Filed: Jul. 31, 1998

[30] Foreign Application Priority Data

Aug. 8, 1997 [JP] Japan ..... 9-214515

[51] Int. Cl.[7] ..... F04B 1/26

[52] U.S. Cl. ..... 417/222.2; 417/269; 417/309

[58] Field of Search ..... 417/222.2, 269, 417/307, 309; 62/498, 501, 503, 510

[56] References Cited

U.S. PATENT DOCUMENTS

| | | | |
|---|---|---|---|
| 4,428,718 | 1/1984 | Skinner | 417/222.2 |
| 4,586,874 | 5/1986 | Hiraga et al. . | |
| 4,842,488 | 6/1989 | Terauchi . | |
| 4,867,649 | 9/1989 | Kawashima et al. . | |
| 4,874,295 | 10/1989 | Kobayashi et al. . | |
| 4,878,817 | 11/1989 | Kikuchi et al. . | |
| 4,960,367 | 10/1990 | Terauchi . | |
| 5,080,561 | 1/1992 | Taguchi . | |
| 5,092,741 | 3/1992 | Taguchi . | |
| 5,240,385 | 8/1993 | Nashiro et al. . | |
| 5,286,172 | 2/1994 | Taguchi . | |
| 5,333,999 | 8/1994 | Sakakura et al. | 417/309 |
| 5,486,098 | 1/1996 | Kimura et al. | 417/222.2 |
| 5,490,767 | 2/1996 | Kanou et al. | 417/222.2 |
| 5,498,140 | 3/1996 | Kawaguchi et al. | 417/199.1 |
| 5,547,346 | 8/1996 | Kanzaki et al. | 417/222.2 |
| 5,577,894 | 11/1996 | Kawaguchi et al. | 417/222.2 |
| 5,624,240 | 4/1997 | Kawaguchi et al. | 417/222.2 |
| 5,993,171 | 11/1999 | Higashiyama | 417/310 |
| 6,045,342 | 4/2000 | Kimura | 417/269 X |

FOREIGN PATENT DOCUMENTS

| | | |
|---|---|---|
| 0283963 | 3/1988 | European Pat. Off. . |
| 0219283 | 10/1996 | European Pat. Off. . |
| 4033422 | 4/1992 | Germany . |
| 474549 | 11/1992 | Japan . |

*Primary Examiner*—Stephen Gravini
*Attorney, Agent, or Firm*—Baker Botts L.L.P.

[57] ABSTRACT

For controlling a displacement depending on a pressure differential between a crank chamber (9) and a suction chamber (4), a compressor is provided with a bleed passage (46) establishing communication between the crank chamber and the suction chamber and with a bleed control mechanism which fully closes the bleed passage while the compressor is stopped. The bleed control mechanism may be a suction valve (15) which controls the opening of suction holes of a valve plate (2) synchronously with a compressing operation of the compressor.

8 Claims, 4 Drawing Sheets

VARIABLE DISPLACEMENT COMPRESSOR IN WHICH A DISPLACEMENT CONTROL IS IMPROVED AT AN INITIAL STAGE OF THE START-UP THEREOF

BACKGROUND OF THE INVENTION

The present invention relates to a variable displacement compressor for use in, for example, compressing a refrigerant gas in a vehicle air conditioner or the like.

A variable displacement compressor of this type is described in, for example, Japanese Second (examined) Patent Publication No. 4-74549. The variable displacement compressor is provided with a suction chamber, a crank chamber and a discharge chamber and controls a displacement thereof depending on a pressure differential between the crank chamber and the suction chamber. For controlling the pressure differential between the crank chamber and the suction chamber, the compressor is provided with a particular passage which is for allowing the flow of gas from the crank chamber into the suction chamber and will be called hereinafter a bleed passage. The bleed passage, even being small, is always opened. Thus, the crank chamber and the suction chamber always communicate with each other.

If both chambers always communicate with each other, assuming that the compressor is stopped for hours and a temperature in a vehicle compartment is relatively high while a temperature around the compressor is relatively low, a phenomenon occurs that a large amount of liquid refrigerant in a low pressure side circuit flows into the crank chamber. If the compressor is started in this state, it is difficult for the liquid refrigerant to escape from the crank chamber so that the pressure differential between the crank chamber and the suction chamber is out of control to be increased. As a result, until the liquid refrigerant is removed from the crank chamber, the compressor continues to be operated with the minimum displacement so that the cooling power becomes insufficient.

SUMMARY OF THE INVENTION

It is therefore an object of the present invention to provide a variable displacement compressor which enables a smooth shift to the maximum displacement at an initial stage of the start-up.

Other objects of the present invention will become clear as the description proceeds. According to one aspect of the present invention, there is provided a variable displacement compressor comprising a suction chamber, a crank chamber, and a discharge chamber and having a displacement controlled dependent on a pressure-difference which is between the crank chamber and the suction chamber. The compressor further comprises a bleed passage establishing communication between the suction chamber and the crank chamber and bleed control means connected to the bleed passage for fully closing the bleed passage while the compressor is stopped.

According to another aspect of the present invention, there is provided a variable displacement compressor comprising a suction chamber having a suction pressure, a crank chamber having a crank pressure, a discharge chamber having a discharge pressure, and displacement control means for controlling a displacement of the compressor in dependence on a differential pressure which is between the crank pressure and the suction pressure. In the variable displacement compressor, the displacement control means comprises a bleed passage establishing communication between the suction chamber and the crank chamber and a bleed control mechanism which fully closes the bleed passage while the compressor is stopped.

According to another aspect of the present invention, there is provided a variable displacement compressor comprising a cylinder block having a plurality of cylinder bores around a central axis extending in a predetermined direction, a plurality of pistons inserted in the cylinder bores, respectively, to be movable in the predetermined direction, a rear housing placed at one end of the cylinder block in the predetermined direction and forming a suction chamber and a discharge chamber, a valve plate placed between the cylinder block and the rear housing, a suction valve placed between the cylinder block and the valve plate for controlling communication between each of the cylinders and each of the suction chamber and the discharge chamber, a front housing placed at another end of the cylinder block in the predetermined direction and forming a crank chamber, a drive shaft extending in the predetermined direction and rotated around the central axis, a crank mechanism connected to the drive shaft and the pistons in the crank chamber for moving the pistons in dependence on the rotation of the drive shaft, a bleed passage establishing communication between the suction chamber and the crank chamber, and bleed control means connected to the bleed passage for fully closing the bleed passage while the compressor is stopped.

BRIEF DESCRIPTION OF THE DRAWING

FIGS. 3A and 3B are enlarged sectional views of a part of the variable displacement compressor shown in FIG. 1, wherein FIG. 3A shows a state where a bellows is contracted, and FIG. 3B shows a state where the bellows is extended.

DESCRIPTION OF THE PREFERRED EMBODIMENT

Figure 1:
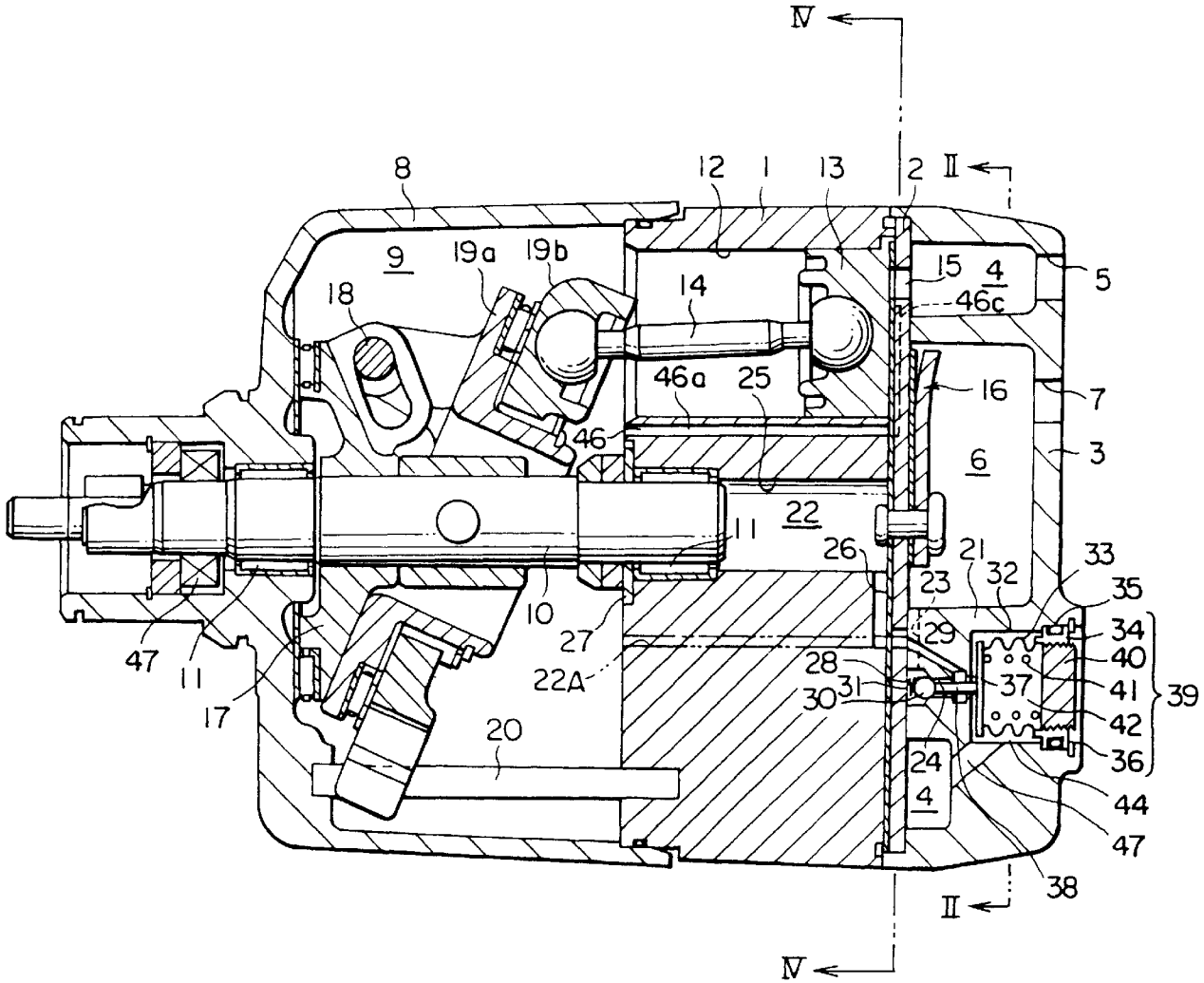
FIG. 1 is a sectional view of a variable displacement compressor according to a preferred embodiment of the present invention.

Referring now to FIG. 1, a variable displacement compressor according to a preferred embodiment of the present invention will be described hereinbelow. The variable displacement compressor is of a wobble plate type known in the art.

The shown variable displacement compressor is for use in, for example, compressing a refrigerant gas in a vehicle air conditioner, and includes a cylinder block 1. On the right side of the cylinder block 1, a rear housing 3 is provided via a valve plate 2 interposed therebetween so as to form a suction chamber 4 and a discharge chamber 6. The suction chamber 4 is connected to a suction port 5, while the discharge chamber 6 is connected to a discharge port 7.

On the left side of the cylinder block 1, a front housing 8 is provided so as to form a crank chamber 9. A drive shaft 10 passes through the crank chamber 9 and extends along a central axis of the cylinder block 1 in a predetermined direction. The drive shaft 10 is rotatably supported on the cylinder block 1 and the front housing 8 via bearings 11.

The cylinder block 1 is provided with a plurality of (five in this embodiment) cylinder bores 12 arranged at regular intervals in a circumferential direction of the cylinder block 1 around the central axis of the cylinder block 1. A piston 13 is received in each of the cylinder bores 12, and a piston rod 14 is connected to each of the pistons 13.

To the valve plate 2, a suction valve 15 and a discharge valve mechanism 16 are attached. A rotor 17 is mounted on the drive shaft 10 and engaged therewith in a rotation direction. A swash plate 19*a* is coupled to the rotor 17 via a coupling pin 18 so as to be variable in inclination. A wobble plate 19*b* is provided so as to confront the swash plate 19*a*. A guide rod 20 is further provided between the cylinder block 1 and the front housing 8. The wobble plate 19*b* is engaged with the guide rod 20 in a rotation direction, and thus it rocks without rotation due to the known principle. The foregoing piston rods 14 are connected to a peripheral portion of the wobble plate 19*b*. A combination of the rotor 17, the swash plate 19*a*, and the wobble plate 19*b* will be referred to as a crank mechanism.

When the rotor 17 and the swash plate 19*a* rotate following the rotation of the drive shaft 10, the wobble plate 19*b* wobbles to cause the pistons 13 to make reciprocating motions in the corresponding cylinder bores 12. Following the reciprocating motions of the pistons 13, the refrigerant gas is sucked into the suction chamber 4 via the suction port 5 and further sucked into the cylinder bores 12 via the suction valve 15 which controls the opening of suction holes of the valve plate 2 synchronously with a compressing operation of the compressor. Then, the refrigerant gas is compressed in the cylinder bores 12, introduced into the discharge chamber 6 via the discharge valve mechanism 16 and then discharged through the discharge port 7.

Figure 2:
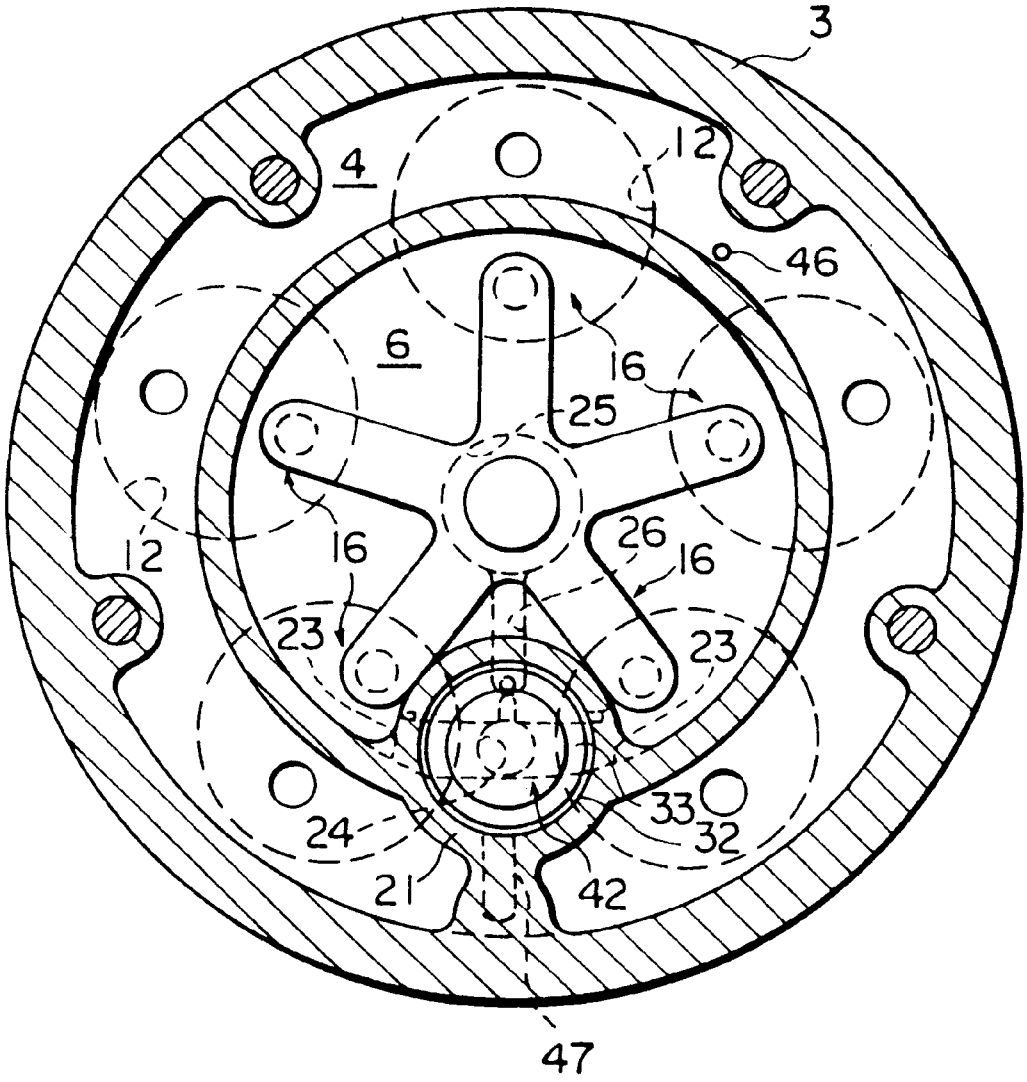
FIG. 2 is a sectional view taken along line II—II in FIG. 1.

Referring also to FIG. 2 in addition to FIG. 1, the rear housing 3 is formed with a swell portion 21 swelling toward the discharge chamber 6. An induction passage 22 is provided for establishing communication between the crank chamber 9 and the discharge chamber 6 via the cylinder block 1, the valve plate 2 and the swell portion 21. The induction passage 22 extends through a passage 23, a passage 24, a passage 26, a bearing bore 25, the bearing 11 and a passage 27.

Figure 3A:
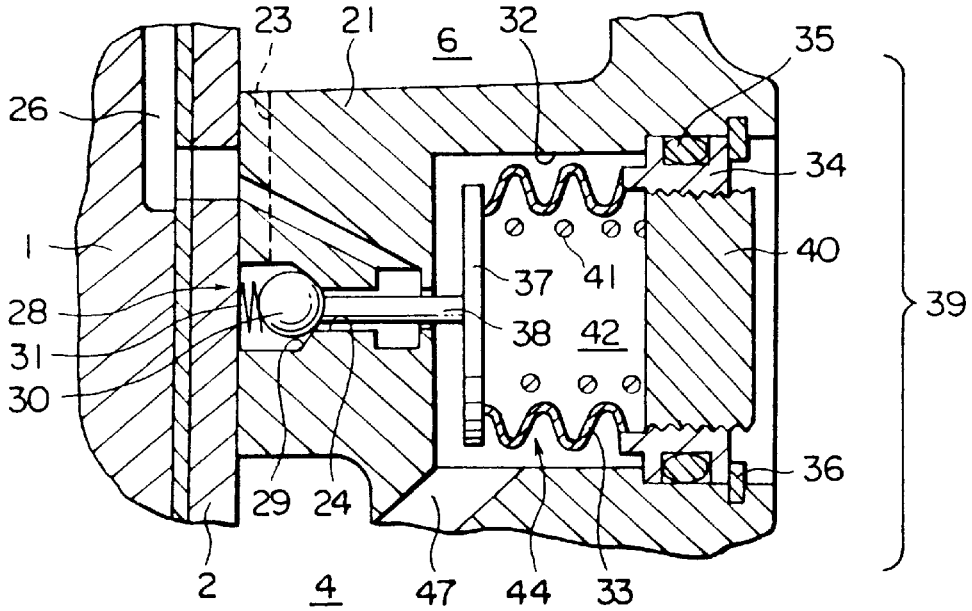
Figure 3B:
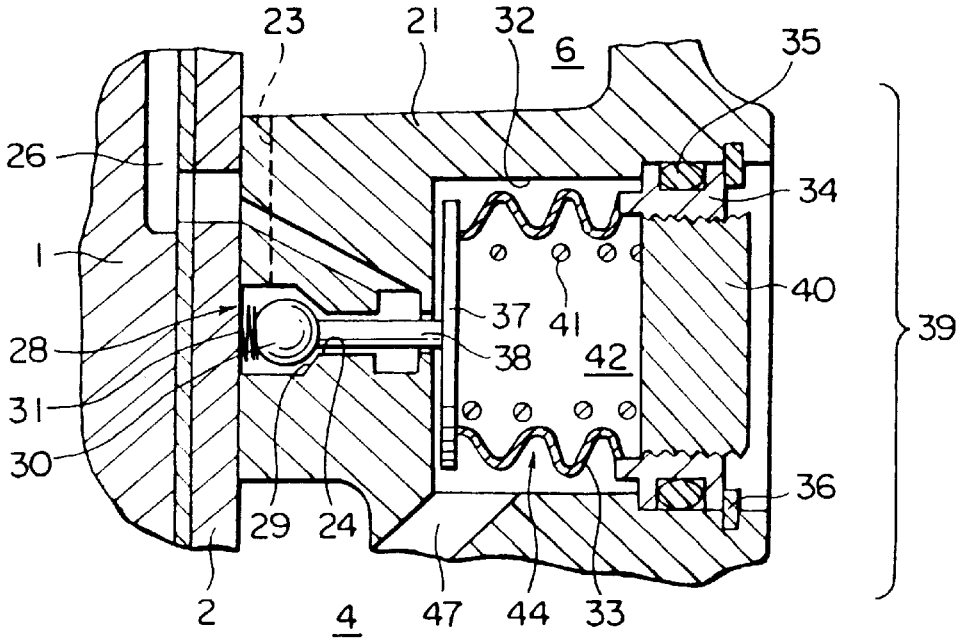

Referring further to FIGS. 3A and 3B, an induction passage open/close valve 28 is provided between the passages 23 and 24 and will be referred to as a passage valve. The induction passage open/close valve 28 comprises a valve seat 29, a ball 30 confronting the valve seat 29, and a compression spring 31 biasing the ball 30 toward the valve seat 29. The swell portion 21 is formed with a recess 32 in which a bellows 33 is disposed using a mounting ring 34 with an O-ring 35 interposed between the mounting ring 34 and an inner periphery of the recess 32, and further retained by a snap ring 36. The bellows 33 has at its tip a mounting plate 37 which holds the ball 30 via a rod 38. Depending on contraction and extension of the bellows 33, the ball 30 is seated on and separated from the valve seat 29 so as to control the opening of the induction passage 22. In this fashion, an induction control mechanism 39 is provided for adjusting the pressure in the crank chamber 9. In the induction control mechanism 39, a combination of the compression spring 31 and the bellows 33 will be referred to as a valve driving arrangement.

A spring support 40 is fixed to the mounting ring 34 and receives thereon a spring 41 applying an extending force to the bellows 33. The inside 42 of the bellows 33 is under vacuum, and a pressure sensitive chamber 44 is defined around the bellows 33. The pressure sensitive chamber 44 communicates with the suction chamber 4 via a passage 47. With this arrangement, according to a pressure in the pressure sensitive chamber 44 and a repulsion force of the compression spring 31, the bellows 33 contracts as shown in FIG. 3A and extends as shown in FIG. 3A. As a result, the opening of the induction passage 22 is controlled to adjust the pressure in the crank chamber 9.

Figure 4:
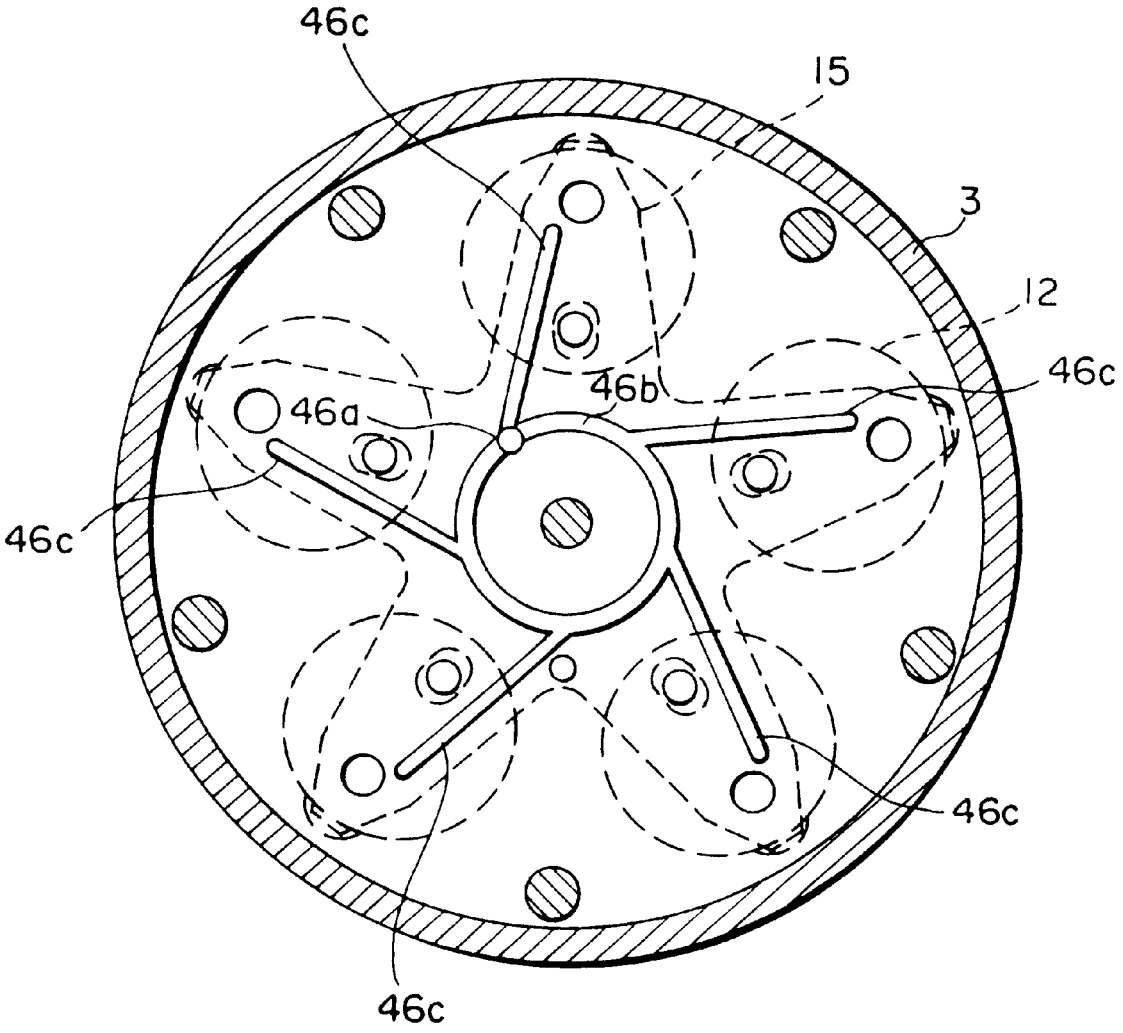
FIG. 4 is a sectional view taken along line IV—IV in FIG. 1.

Referring now to FIGS. 1 and 4, a bleed passage 46 is provided for establishing communication between the suction chamber 4 and the crank chamber 9. The bleed passage 46 has a through hole 46*a* extending through the cylinder block 1 and the suction valve 15 in an axial direction, an annular groove 46*b* formed on a surface of the valve plate 2 confronting the cylinder block 1 so as to communicate with the through hole 46*a*, and five extension grooves 46*c* formed on the foregoing surface of the valve plate 2 and extending outward from the annular groove 46*b* to positions corresponding to the respective five cylinder bores 12 while confronting the suction valve 15.

During a normal operation of the variable displacement compressor, the refrigerant gas flows as bow-by gas from the cylinder bores 12 into the crank chamber 9 as well known in the art. When the pressure in the suction chamber 4 is not less than a set value, the bellows 33 and the spring 41 contract so that the ball 30 abuts the valve seat 29 under pressure to block the induction passage 22. In this state, the blow-by gas returns from the crank chamber 9 to the cylinder bores 12 through the bleed passage 46. Therefore, the pressure in the crank chamber 9 becomes relatively lower so that the inclination of the swash plate 19*a* varies to increase the discharge capacity.

On the other hand, when the pressure in the suction chamber 4 is smaller than the set value, the bellows 33 and the spring 41 extend so that the ball 30 is separated from the valve seat 29 to open the induction passage 22. In this state, the refrigerant gas flows from the discharge chamber 6 into the crank chamber 9 through the induction passage 22. Therefore, the pressure in the crank chamber 9 becomes relatively higher so that the inclination of the swash plate 19*a* varies to decrease the discharge capacity.

When the variable displacement compressor is stopped, the suction valve 15 fully closes the bleed passage 46 so that the communication between the crank chamber 9 and the suction chamber 4 is disabled. In this event, the suction valve 15 serves as a bleed control arrangement or mechanism. Therefore, when the temperature in the vehicle compartment is high while the temperature around the compressor is low after the compressor has been stopped for hours, the liquid refrigerant in the low pressure side circuit is prevented from flowing into the crank chamber 9 so that the shift to the maximum displacement can be smoothly carried out at the initial stage of the start-up. In this case, the suction valve 15 constitutes a bleed control mechanism.

With the variable displacement compressor, since the bleed passage 46 is closed while the compressor is stopped, the liquid refrigerant is prevented from flowing into the crank chamber 9 so that the shift to the maximum displacement can be smoothly carried out at the initial stage of the start-up.

While the present invention has thus far been described in conjunction with the single preferred embodiment thereof, it will readily be possible for those skilled in the art to put this invention into practice in various other manners. For example, the present invention is applicable to a variable displacement compressor of a single swash plate type known in the art.

What is claimed is:

1. A variable displacement compressor comprising a suction chamber, a crank chamber, and a discharge chamber and having a displacement controlled dependent on a pressure-difference which is between said crank chamber and said suction chamber, said compressor further comprising:

a bleed passage establishing communication between said suction chamber and said crank chamber; and bleed control means connected to said bleed passage for fully closing said bleed passage while the compressor is stopped.

2. A variable displacement compressor as claimed in claim 1, further comprising:

a valve plate closing said suction chamber and having a suction hole communicated with said suction chamber;

a suction valve coupled to said valve plate for controlling opening of said suction hole synchronously with a compressing operation of the compressor, said suction valve serving as said bleed control means to close said bleed passage together with said suction hole.

3. A variable displacement compressor as claimed in claim 2, further comprising a cylinder bore communicable with said suction chamber and said discharge chamber through said suction hole, said valve plate extending between said suction chamber and said cylinder bore, said suction valve extending between said valve plate and said cylinder bore, said bleed passage extending on said valve plate and being closed by said suction valve to communicate with said cylinder bore only when said suction valve opens said suction hole.

4. A variable displacement compressor as claimed in claim 1, further comprising:

an induction passage establishing communication between said discharge chamber and said crank chamber; and induction control means connected to said induction passage for controlling opening of said induction passage to adjust a pressure in said crank chamber.

5. A variable displacement compressor as claimed in claim 4, wherein said induction control means comprises:

a passage valve coupled to said induction passage for opening and closing said induction passage; and valve driving means connected to said passage valve and said suction chamber and responsive to the pressure of said suction chamber for driving said passage valve to open and close said induction passage.

6. A variable displacement compressor comprising:

a suction chamber having a suction pressure;

a crank chamber having a crank pressure;

a discharge chamber having a discharge pressure; and displacement control means for controlling a displacement of the compressor in dependence on a differential pressure which is between said crank pressure and said suction pressure;

said displacement control means comprising:

a bleed passage establishing communication between said suction chamber and said crank chamber; and a bleed control mechanism which fully closes said bleed passage while the compressor is stopped.

7. A variable displacement compressor comprising:

a cylinder block having a plurality of cylinder bores around a central axis extending in a predetermined direction;

a plurality of pistons inserted in said cylinder bores, respectively, to be movable in said predetermined direction;

a rear housing placed at one end of said cylinder block in said predetermined direction and forming a suction chamber and a discharge chamber;

a valve plate placed between said cylinder block and said rear housing;

a suction valve placed between said cylinder block and said valve plate for controlling communication between each of said cylinders and each of said suction chamber and said discharge chamber;

a front housing placed at another end of said cylinder block in said predetermined direction and forming a crank chamber;

a drive shaft extending in said predetermined direction and rotated around said central axis;

a crank mechanism connected to said drive shaft and said pistons in said crank chamber for moving said pistons in dependence on the rotation of said drive shaft;

a bleed passage establishing communication between said suction chamber and said crank chamber; and bleed control means connected to said bleed passage for fully closing said bleed passage while the compressor is stopped.

8. A variable displacement compressor as claimed in claim 7, wherein said bleed passage comprises:

a through hole extending through said cylinder block in said predetermined direction;

an annular groove formed around said central axis on a surface of said valve plate confronting said cylinder block so as to communicate with said through hole; and a plurality of extension grooves formed on said surface of the valve plate and extending outward from said annular groove to said cylinder bores, respectively, said extension grooves confronting said suction valve.

* * * * *